US007584747B1

(12) United States Patent
Ibrahim et al.

(10) Patent No.: US 7,584,747 B1
(45) Date of Patent: Sep. 8, 2009

(54) CAM ASSISTED COMMON RAIL FUEL SYSTEM AND ENGINE USING SAME

(75) Inventors: Daniel R. Ibrahim, Metamora, IL (US); Stephen R. Lewis, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/079,292

(22) Filed: Mar. 26, 2008

(51) Int. Cl.
*F02M 69/46* (2006.01)
*F02M 69/50* (2006.01)

(52) U.S. Cl. ..... 123/456; 123/478

(58) Field of Classification Search ..... 123/456, 123/447, 446, 478, 467, 458, 459; 417/225, 417/226, 227
See application file for complete search history.

(56) References Cited

U.S. PATENT DOCUMENTS 5,413,076 A 5/1995 Koenigswieser et al.
6,644,282 B2 11/2003 Schwarz
6,688,536 B2 2/2004 Coldren et al.
7,263,974 B2 * 9/2007 Knight ..... 123/446
7,293,547 B2 11/2007 Ibrahim
2005/0150972 A1 7/2005 Dong et al.
2006/0243253 A1 * 11/2006 Knight ..... 123/447
2007/0175448 A1 8/2007 Shinogle et al.
2008/0011274 A1 * 1/2008 Goney et al. ..... 123/446

OTHER PUBLICATIONS

SOE, Best of Both Worlds at Euro-6?, Latest News, Nov. 1, 2006, pp. 1-2, published on the World Wide Web at http://www.soe.org.uk/news/item.php?id=685, 2008.
SAE OHE, Delphi looks into diesel's future, Jun. 2007, pp. 6-8.

* cited by examiner

*Primary Examiner*—Mahmoud Gimie
(74) *Attorney, Agent, or Firm*—Liell & McNeil

(57) ABSTRACT

A fuel system for an internal combustion engine includes a plurality of nozzle groups and a plurality of pump groups. A common rail is fluidly connected with each of the nozzle groups, and each of the pump groups includes a mechanically actuated pressure intensifier having a tappet which can selectively intensify a fuel injection pressure in a corresponding one of the nozzle groups. Each of the mechanically actuated pressure intensifiers is movable in response to rotation of a cam, and includes a spill valve having a first position at which fuel is displaced from the pump group to a low pressure space and a second position at which fuel is displaced to a corresponding one of the nozzle groups.

18 Claims, 2 Drawing Sheets

CAM ASSISTED COMMON RAIL FUEL SYSTEM AND ENGINE USING SAME

TECHNICAL FIELD

The present disclosure relates generally to common rail fuel systems for internal combustion engines, and relates more particularly to selectively injecting fuel at an elevated pressure via a mechanically actuated pressure intensifier in a common rail fuel system.

BACKGROUND

Many types of fuel injection systems for internal combustion engines have been developed over the years. Common rail fuel injection systems are widely used in connection with multi-cylinder internal combustion engines. A typical common rail fuel system may include a low pressure fuel source such as a fuel tank, a high pressure pump which receives fuel from the fuel tank and increases the fuel pressure to a relatively high pressure, and a common rail connecting with the high pressure pump. The common rail serves as a source of high pressure fuel for a plurality of fuel injectors associated one with each of a plurality of cylinders. Injection of fuel at the relatively high pressure of the common rail can occur relatively precisely by electronically controlling each of the fuel injectors coupled with the common rail. The high pressure fuel pump replenishes fuel consumed via fuel injection events, and maintains the rail pressure at a desired level. Common rail systems have seen widespread success in part because they provide a relatively simple and straightforward means for providing fuel to a plurality of engine cylinders via fuel injectors, and also because common rail systems have proven to be a relatively efficient and effective way to handle relatively high fuel pressures.

Common rail fuel systems have enabled engine designs and operating methods having a number of advantages over other strategies. On the one hand, injecting fuel at the relatively high pressures attainable with a common rail can increase fuel atomization in an engine cylinder and thus improve certain factors such as combustion rate and combustion completeness. Relatively high injection pressures can also be useful in controllably injecting relatively precise quantities of fuel for a variety of purposes. To further improve upon these and other advantages, engineers continue to seek out strategies for injecting fuel at ever increasing injection pressures. While common rails have long served as an industry standard for high pressure fuel injection practices, they are not without drawbacks.

For example, containing a volume of extremely highly pressurized fuel can be sometimes difficult, requiring specialized hardware, such as seals and plumbing, which can withstand the high fuel pressures. In addition, parts subjected to extremely high pressures can have a tendency to wear relatively more quickly than parts in lower pressure environments. It can also take significant engine output energy to maintain a relatively large volume of fuel at high pressure. Relying solely upon a common rail as an engine's fuel source can ultimately impact engine efficiency.

Earlier systems are known where a cam-driven piston pressurizes fuel in a fuel injector to enable fuel injection at a relatively high pressure. These systems differ from common rail systems in that fuel pressurization takes place individually at each fuel injector, rather than relying on a common high pressure fuel source. One advantage to cam actuation is that the available power for pressurizing fuel tends to be relatively high. Hence, the pressure capabilities of certain cam actuated fuel injectors are even higher than those of conventional common rail systems. A potential drawback to cam actuation is that controllability may be less than that of common rail systems. Other systems provide two different sources of fuel to enable injection at a relatively low pressure and also injection at a relatively high pressure when desired.

Still another concept which attempts to provide both a lower injection pressure and a higher injection pressure is known from U.S. Pat. No. 5,413,076 to Koenigswieser et al. ("Koenigswieser"). In Koenigswieser, a common rail is provided which is connected with a plurality of fuel injectors. Each of the fuel injectors includes a booster piston which has an end face capable of receiving fluid pressure from the common rail. The fuel injectors in Koenigswieser can be used to inject fuel at a rail pressure, then at a relatively higher pressure via common rail actuation of the piston. While systems such as that shown in Koenigswieser may provide certain advantages, they still suffer from fluid containment and other issues.

SUMMARY

In one aspect, a fuel system for an internal combustion engine includes a plurality of nozzle groups, each of the nozzle groups having a nozzle body with a fuel inlet and at least one nozzle outlet, a control passage, a nozzle supply passage and a drain. Each of the nozzle groups further includes a needle check movable between a first check position blocking the at least one nozzle outlet from the nozzle supply passage and a second check position where the at least one nozzle outlet is open to the nozzle supply passage. Each needle check further has a closing hydraulic surface exposed to a fluid pressure of the corresponding control passage. The fuel system further includes a common rail fluidly connecting with the fuel inlet of each of the nozzle groups and configured to supply a pressurized fuel to each of the nozzle groups at a first pressure. The fuel system further includes a plurality of pump groups each configured to supply a pressurized fuel to one of the nozzle groups at a second, higher pressure, each pump group including a mechanically actuated pressure intensifier having a tappet. Each of the nozzle groups further includes an electrically actuated needle control valve configured to control the needle check and being movable between a first needle control valve position blocking the control passage from the drain, and a second needle control valve position at which the control passage is open to the drain. Each of the pump groups further includes an electrically actuated pump valve which includes a spill valve movable between a first pump valve position at which fuel is displaced from the pump group to a low pressure space and a second pump valve position at which fuel is displaced from the pump group to the nozzle supply passage of the corresponding nozzle group.

In another aspect, a method of operating a fuel system for an internal combustion engine includes a step of injecting fuel into an engine cylinder at a first pressure by fluidly connecting a nozzle outlet of a nozzle group with a common rail. The method further includes a step of injecting fuel into the engine cylinder at a second, higher pressure by moving a tappet of a mechanically actuated pressure intensifier in response to rotation of a cam.

In still another aspect, a fuel injector includes an injector body having a nozzle group and a pump group, the injector body further including a high pressure fuel inlet connecting with the nozzle group and a low pressure fuel inlet connecting with the pump group. The nozzle group includes a nozzle supply passage, at least one nozzle outlet, a control passage and a drain. The nozzle group further includes a needle check movable between a first check position blocking the at least one nozzle outlet from the nozzle supply passage and a second check position where the at least one nozzle outlet is open to the nozzle supply passage. The needle check has at least one opening hydraulic surface and a closing hydraulic surface exposed to a fluid pressure of the control passage. The fuel injector further includes a first electrically actuated valve movable between a first position blocking the control passage from the drain and a second position at which the control passage is open to the drain. The pump group includes a mechanically actuated pressure intensifier having a tappet, and the pump group defines a pressure intensification passage connecting with the nozzle supply passage. The fuel injector further includes a second electrically actuated valve which includes a spill valve movable between a first spill valve position and a second spill valve position, wherein at the first spill valve position fluid is displaced from the pump group to a low pressure space and at the second spill valve position fluid is displaced from the pump group to the pressure intensification passage.

DETAILED DESCRIPTION

Figure 1:
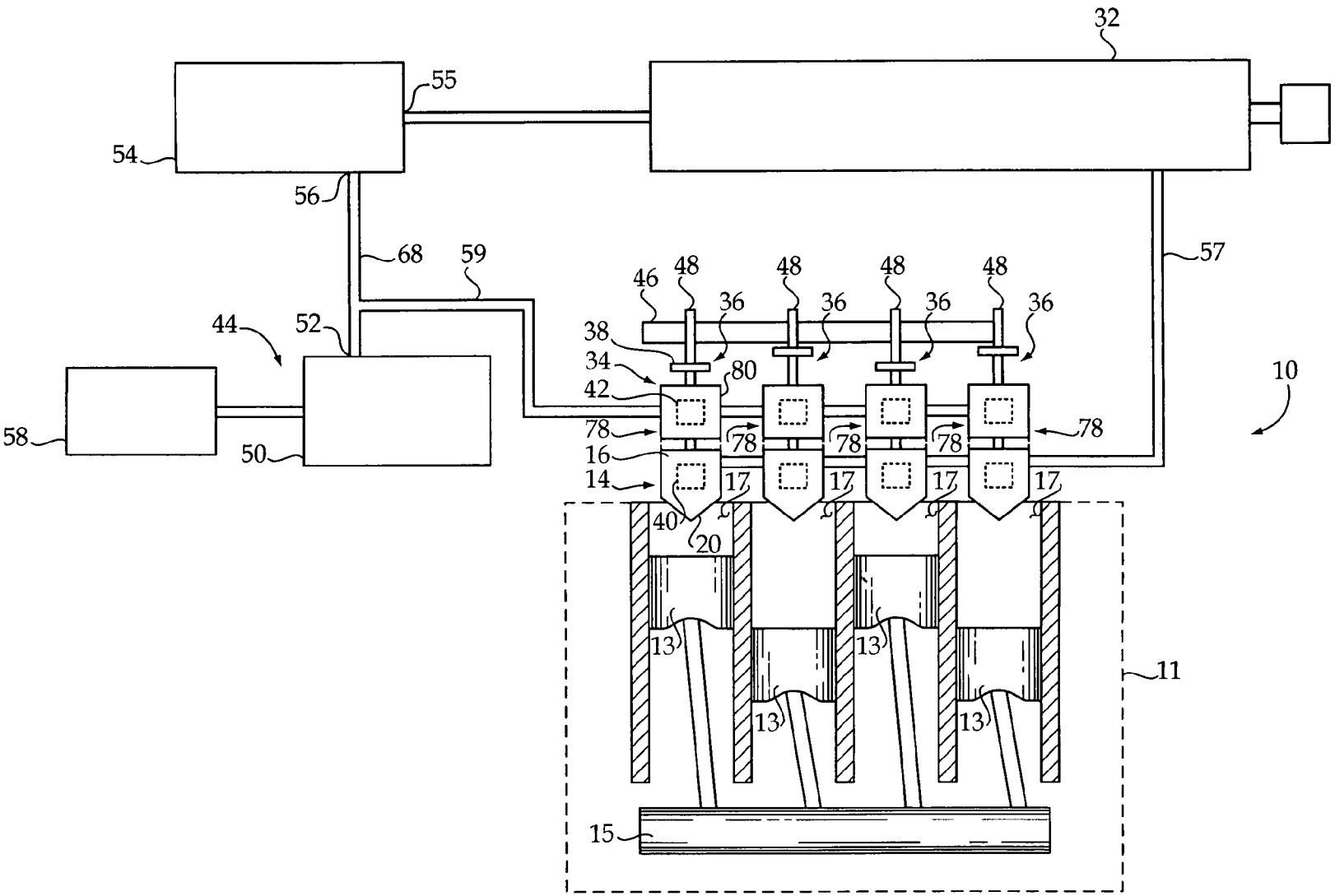
FIG. 1 is a diagrammatic view, partially sectioned, of an internal combustion engine having a fuel system, according to one embodiment.

Referring to FIG. 1, there is shown an internal combustion engine 10 according to one embodiment. Internal combustion engine 10 may comprise a direct injection compression ignition diesel engine, but might comprise a spark ignited engine, or an engine with a different injection strategy, in other embodiments. Engine 10 may include an engine housing 11 which includes a plurality of cylinders 17 disposed therein. A plurality of pistons 13 are associated one with each of cylinders 17, and are coupled with a crankshaft 15 in a conventional manner. A plurality of fuel injectors 78 are associated one with each of cylinders 17, and each extend partially into a corresponding one of cylinders 17. In one embodiment, each of fuel injectors 78 may include an injector body 80 which has a nozzle group 14 which comprises a nozzle body 16, and a pump group 34.

Engine 10 may further include a common rail 32 which is fluidly connected with each one of fuel injectors 78 via a high pressure supply conduit 57. Each nozzle group 14 may include an electrically actuated valve or needle control valve 40 which is configured to control injection of fuel via the corresponding fuel injector 78 from high pressure supply conduit 57. Each nozzle body 16 may include one or more nozzle outlets 20 which open to the corresponding cylinder 17 for injecting fuel therein.

Each pump group 34 may further include a mechanically actuated pressure intensifier 36 having a tappet 38. Engine 10 may further include a camshaft 46 which has a plurality of cam lobes 48 each configured to contact a corresponding tappet 38. Common rail 32, conduit 57 and fuel injectors 78 may be part of a fuel system 12. Fuel system 12 also includes a fuel tank 58 fluidly connected with a fuel transfer pump 50. Fuel transfer pump 50 may include a fuel outlet 52 connecting with a fuel supply conduit 68 connecting in turn with an inlet 56 of a high pressure pump 54. High pressure pump 54 may include an outlet 55 which fluidly connects with common rail 32 in a conventional manner. Another fuel supply conduit 59 comprising a low pressure fuel conduit may connect with conduit 68, and can supply fuel at a relatively low pressure corresponding to an outlet pressure of fuel transfer pump 50 to each of pump groups 34.

In one embodiment, each pump group 34 may include a second electrically actuated valve or pump valve 42 which is configured to control injection of fuel via the corresponding fuel injector 78 from the corresponding pump group 34. Each pump group 34 may by way of its associated mechanically actuated pressure intensifier 36 supply fuel to the corresponding nozzle group 14 at a pressure which is relatively higher than the pressure supplied by way of conduit 57 from common rail 32. Fuel tank 58, fuel transfer pump 50, and conduits 68 and 59 may be understood as comprising a low pressure space 44. In one embodiment, each electrically actuated valve 42 associated with one of pump groups 34 may comprise a spill valve movable between a first spill valve position at which fuel is displaced from the corresponding pump group 34 to low pressure space 44 and a second spill valve position at which fuel is displaced form the corresponding pump group 34 to a nozzle supply passage (not shown) of the corresponding nozzle group 14, as further explained herein.

Figure 2:
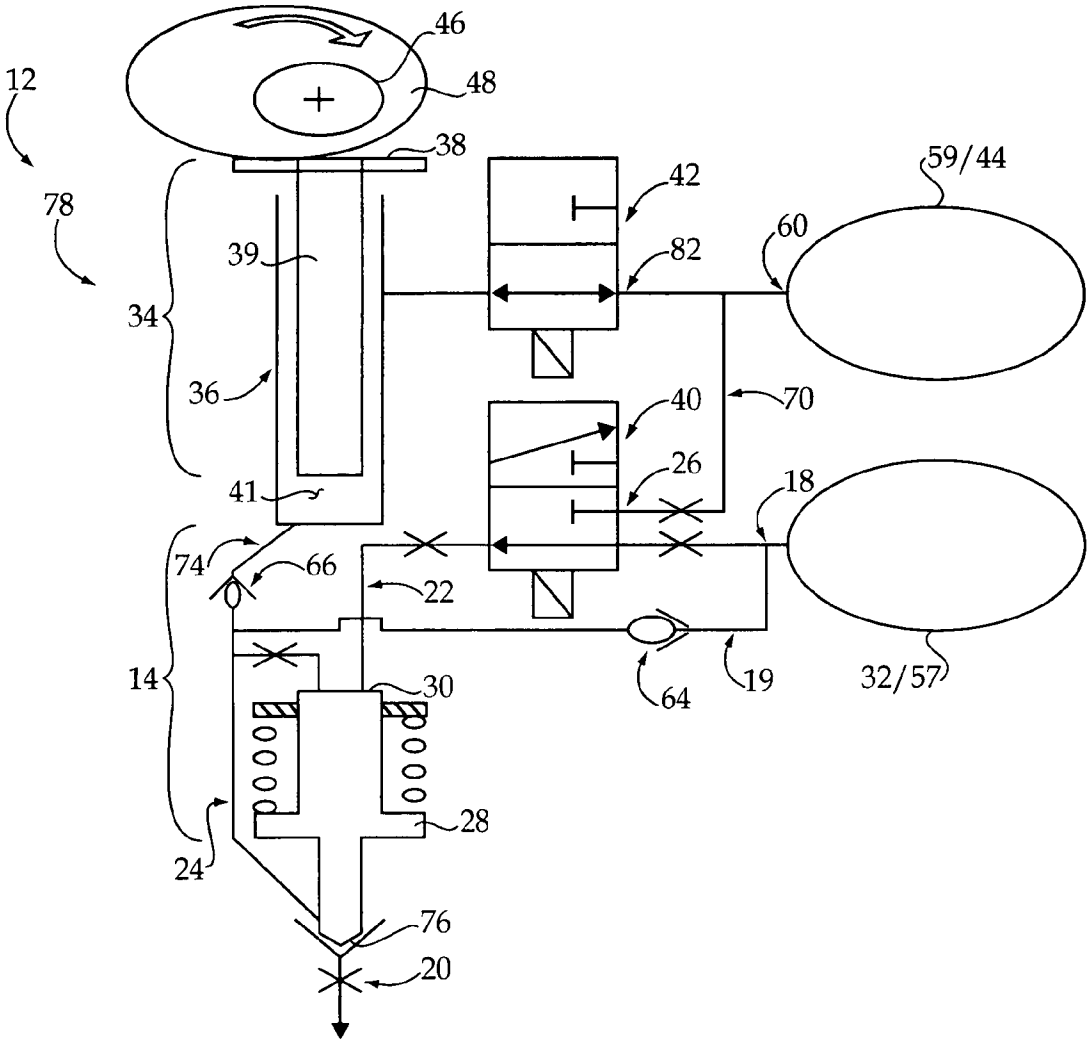
FIG. 2 is a diagrammatic view of a portion of the fuel system of FIG. 1, according to one embodiment.

Referring also now to FIG. 2, there is shown a diagrammatic illustration of certain of the components of fuel system 12, in particular components associated with one fuel injector 78. Accordingly, the following description should be understood to refer to any one of fuel injectors 78 shown in FIG. 1, as fuel injectors 78 will typically be identical. It may be noted that common rail 32, via conduit 57, connects with a fuel inlet 18 of nozzle group 14, comprising a high pressure inlet 18. Low pressure space 44 connects with another fuel inlet 60, comprising a low pressure inlet 60, by way of conduit 59 to pump group 34. It will be recalled that each of pump group 34 and nozzle group 14 may comprise parts of the same fuel injector 78. It should be appreciated, however, that in other embodiments pump group 34 might be a component separate from nozzle group 14, and housed in a separate body or even at a separate location than that of nozzle group 14.

It may further be noted in FIG. 2 that nozzle group 14 includes an outlet check or needle check 28 which is configured to control fluid communications between nozzle outlets 20 and a nozzle supply passage 24. Outlet check 28 may comprise a needle check which includes one or more opening hydraulic surfaces 76, and also includes a closing hydraulic surface 30. Electrically actuated valve 40 is also shown in FIG. 2 and may be positioned fluidly between a control passage 22 and a drain 26 to selectively connect control passage 22 with drain 26 and thereby control a fluid pressure applied to closing hydraulic surface 30, and thus control opening and closing of nozzle outlets 20 with needle check 28 in a conventional manner.

FIG. 2 further illustrates certain of the elements of mechanically actuated pressure intensifier 36, namely, a plunger 39 whereupon tappet 38 is disposed. Cam lobe 48, coupled with camshaft 46 is also shown in FIG. 2. During operation of engine 10, camshaft 46 may rotate, rotating cam lobe 48 against tappet 38 and inducing plunger 39 to move between a first position and a second position. Second electrically actuated valve 42 is also shown in FIG. 2, and may be configured to control fluid communications between low pressure space 44 and mechanically actuated pressure intensifier 36. When electrically actuated valve 42 is in a first valve position, approximately as shown in FIG. 2, reciprocation of plunger 39 will tend to draw fluid via a passage 82 from fuel inlet 60 into a pump chamber 41, then expel fluid via passage 82 back to low pressure space 44. Accordingly, passage 82 may comprise a bi-directional passage, valve 42 may comprise a bi-directional spill valve and mechanically actuated pressure intensifier 36 will tend to move fuel back and forth between pump chamber 41 and low pressure space 44, when electrically actuated valve 42 is at its first position.

Electrically actuated valve 42 is movable to a second valve position at which pump chamber 41 is blocked from passage 82. In the second position of electrically actuated valve 42, plunger 39 will have a tendency to expel fluid from pump chamber 41 into a pressure intensification passage 74 and thenceforth to nozzle supply passage 24. Thus, as further described herein engine 10 may be operated in a first mode where fuel is supplied at a first, rail pressure to nozzle supply passage 24, and electrically actuated valve 40 is used to control fuel injection via outlet 20 by selectively connecting control passage 22 with drain 26. In another operating mode, each of electrically actuated valves 40 and 42 may be used such that fuel pressurized via mechanically actuated pressure intensifier 36 to a second, relatively higher pressure may be injected, as further described herein.

In one embodiment, nozzle group 14 may include a one-way valve such as a ball check 64 which is disposed in parallel with valve 40 and at least partially within an inlet passage 19 connecting with common rail 32 and supply conduit 57 via fuel inlet 18. By positioning ball check 64 in passage 19, fluidly between inlet 18 and nozzle supply passage 24, relatively high pressure fuel supplied to nozzle group 14 from pressure intensifier 36 via pressure intensification passage 74 will be blocked from common rail 32 and conduit 57. Ball check 64 may thus block a flow of fuel from pressure intensifier 36 to common rail 32 during injecting fuel via pressure intensifier 36. A second one-way valve which may also comprise a ball check 66 may be positioned at least partially within pressure intensification passage 74 and fluidly between nozzle supply passage 24 and pump chamber 41. Accordingly, fuel from common rail 32 will be blocked from flowing to pump chamber 41 of pressure intensifier 36, for example when plunger 39 is retracting, or moving upward in the FIG. 2 illustration.

Fuel injector 78 may further include a fuel return conduit 70 which connects drain 26 with passage 82, and therefore with low pressure space 44. When electrically actuated valve 40 is moved to connect control passage 22 with drain 26, high pressure fuel from control passage 22 can be returned to low pressure space 44 via fuel return conduit 70. Thus, moving valve to connect control passage 22 with fuel return conduit 70 fluidly connects control passage 22 with low pressure space 44 via second inlet 60. Engine 10 may thus include a plurality of fuel return conduits 70, one for each fuel injector 78, which each connect a drain 26 of one of fuel injectors 78 with low pressure space 44.

INDUSTRIAL APPLICABILITY

The present disclosure provides a common rail fuel system which may selectively inject fuel at an elevated pressure via a mechanically actuated pressure intensifier. By coupling a mechanically actuated pressure intensifier 36 with each fuel injector 78, the relatively high pressures available via cam rotation are available as needed by actuating valve 42. Moreover, these relatively high pressures may be achieved without wasting energy in pressurizing or displacing fuel. In other words, because each mechanically actuated pressure intensifier 36 draws fuel from low pressure space 44, then returns fuel to low pressure space 44, there is relatively little energy consumption in moving each pressure intensifier 36 when valve 42 is fluidly connecting chamber 41 with low pressure space 44. Efficiency and economy are further improved by returning fuel at rail pressure from control passage 22 to low pressure space 44, rather than draining high pressure fuel to a fuel tank. The presently disclosed strategy also provides the advantages commonly associated with common rail technology, such as economical operation and precise control over fuel injection.

During typical engine operation, injection via common rail 32 is expected to take place much of the time. Accordingly, each of pistons 13 will reciprocate in their corresponding cylinder 17, and each of fuel injectors 78 will be operated to inject fuel from common rail 32 at a first injection pressure. Thus, electrically actuated valve 40 may be moved from a first needle control valve position at which control passage 22 is blocked from drain 26 to a second needle control valve position at which control passage 22 is open to drain 26. Since relatively high pressure from common rail 32 will be continuously available via passage 19 to nozzle supply passage 24, actuation of valve 40 may be used to control injection events. Fuel will typically be spilling from pressure intensifier 36 back to low pressure space 44 during injecting fuel from common rail 32 at the first pressure. At certain times, or under certain operating conditions, injection at a second, relatively higher injection pressure may be desired. When injection at the relatively higher pressure is desired, pressure intensifier 36 may be used to supply relatively higher pressure fuel to pressure intensification passage 74 from pump chamber 41, and thenceforth to nozzle supply passage 24. Thus, tappet 38 may ordinarily be moving in response to rotation of camshaft 46, and pressure intensifier 36 may be operating more or less passively, filling pump chamber 41 and displacing fuel back to low pressure space 44 from pump chamber 41 by following lobe 48 of camshaft 46 with tappet 38. At the time at which injection at the second, higher pressure is desired, or just prior to such time, electrically actuated valve 42 may be moved to its second position to block passage 82 from pump chamber 41. Simultaneously with moving valve 42 to its second position, or shortly thereafter, valve 40 may be actuated to reduce pressure on closing hydraulic surface 30 to enable outlet check 28 to open.

The present description is for illustrative purposes only and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims.

What is claimed is:

1. A fuel system for an internal combustion engine comprising:

a plurality of nozzle groups, each of the nozzle groups having a nozzle body with a fuel inlet and at least one nozzle outlet, a control passage, a nozzle supply passage and a drain, each of the nozzle groups further including a needle check movable between a first check position blocking the at least one nozzle outlet from the nozzle supply passage and a second check position where the at least one nozzle outlet is open to the nozzle supply passage, and each needle check further having a closing hydraulic surface exposed to a fluid pressure of the corresponding control passage;

a common rail fluidly connecting with the fuel inlet of each of the nozzle groups and configured to supply a pressurized fuel to the nozzle supply passage of each of the nozzle groups at a first pressure;

a plurality of pump groups each configured to supply a pressurized fuel to the nozzle supply passage of one of the nozzle groups at a second, higher pressure, each pump group including a mechanically actuated pressure intensifier having a tappet;

each of the nozzle groups further including an electrically actuated needle control valve configured to control the needle check and being movable between a first needle control valve position blocking the control passage from the drain, and a second needle control valve position at which the control passage is open to the drain; and each of the pump groups further including an electrically actuated pump valve comprising a spill valve movable between a first pump valve position at which fuel is displaced from the pump group to a low pressure space and a second pump valve position at which fuel is displaced from the pump group to the nozzle supply passage of the corresponding nozzle group; and the fuel system further including a plurality of check valves each being positioned fluidly between one of the plurality of pump groups and the nozzle supply passage of one of the plurality of nozzle groups and blocking fluid flow from the common rail to the corresponding pump group.

2. The fuel system of claim 1 further comprising a common camshaft having a plurality of cam lobes which each contact one of the tappets.

3. The fuel system of claim 2 further comprising a fuel tank, a fuel transfer pump fluidly connected with the fuel tank and having an outlet, and a high pressure pump for the common rail having an inlet, wherein the low pressure space comprises a fuel supply conduit fluidly connecting with the outlet of the fuel transfer pump, the fuel supply conduit further being fluidly connected with a fuel inlet of each one of the pump groups.

4. The fuel system of claim 3 wherein each one of the pump groups includes a pump chamber, and wherein the electrically actuated pump valve of each pump group comprises a bi-directional valve positioned fluidly between the fuel supply conduit and the pump chamber of the corresponding pump group.

5. The fuel system of claim 3 wherein the electrically actuated needle control valve of each one of the nozzle groups is positioned fluidly between the control passage and the drain of the corresponding nozzle group.

6. The fuel system of claim 5 further comprising a plurality of one-way valves each positioned fluidly between the fuel inlet of one of the nozzle groups and the nozzle supply passage of one of the nozzle groups and being disposed in parallel with the electrically actuated needle control valve of the one of the nozzle groups.

7. The fuel system of claim 1 wherein each one of the pump groups includes a pump chamber, and wherein the electrically actuated pump valve of each pump group comprises a bi-directional valve positioned fluidly between the fuel supply conduit and the pump chamber of the corresponding pump group.

8. The fuel system of claim 3 further comprising a plurality of fuel return conduits each fluidly connecting the drain of one of the nozzle groups with the low pressure space, and wherein the electrically actuated needle control valve of each one of the nozzle groups is configured to connect the control passage with the low pressure space via one of the fuel return conduits at the second needle control valve position of the electrically actuated needle control valve.

9. A method of operating a fuel system for an internal combustion engine comprising the steps of:

injecting fuel into an engine cylinder at a first pressure by fluidly connecting a nozzle outlet of a nozzle group with a common rail; and injecting fuel into the engine cylinder at a second, higher pressure by moving a tappet of a mechanically actuated pressure intensifier in response to rotation of a cam;

the step of injecting fuel into the engine cylinder at the first pressure further including injecting fuel while pressurizing fuel within a pump chamber of the mechanically actuated pressure intensifier to a pressure less than a pressure of fuel within the common rail.

10. The method of claim 9 wherein:

the step of injecting fuel at the first pressure includes a step of supplying high pressure fuel from the common rail to the nozzle outlet by way of a high pressure fuel inlet; and the method further comprises a step of supplying low pressure fuel from a low pressure fuel conduit to the mechanically actuated pressure intensifier by way of a low pressure fuel inlet.

11. The method of claim 10 further comprising the steps of:

blocking the mechanically actuated pressure intensifier from the nozzle group during injecting fuel at the first pressure by way of a first one-way valve positioned fluidly between the mechanically actuated pressure intensifier and the nozzle group; and blocking the common rail from the nozzle group during injecting fuel at the second, higher pressure by way of a second one-way valve positioned fluidly between the nozzle group and the common rail.

12. The method of claim 11 further comprising a step of spilling fuel from the mechanically actuated pressure intensifier to a low pressure space during injecting fuel at the first pressure.

13. The method of claim 11 wherein the step of supplying low pressure fuel to the mechanically actuated pressure intensifier further comprises filling a pump chamber of the mechanically actuated pressure intensifier at least in part by following a lobe of the cam with the tappet.

14. The method of claim 10 further comprising a step of controlling a needle check of the nozzle group at least in part by controlling a fluid pressure applied to a closing hydraulic surface of the needle check via a control passage.

15. The method of claim 14 further comprising a step of establishing a fluid connection between the control passage and the low pressure fuel inlet.

16. A fuel injector comprising:

an injector body which includes a nozzle group and a pump group, the injector body further including a high pressure fuel inlet connecting with the nozzle group and a low pressure fuel inlet connecting with the pump group;

the nozzle group including a nozzle supply passage, at least one nozzle outlet, a control passage and a drain, and a needle check movable between a first check position blocking the at least one nozzle outlet from the nozzle supply passage and a second check position where the at least one nozzle outlet is open to the nozzle supply passage, and the needle check having at least one opening hydraulic surface and a closing hydraulic surface exposed to a fluid pressure of the control passage;

a first electrically actuated valve movable between a first position blocking the control passage from the drain and a second position at which the control passage is open to the drain;

the pump group including a mechanically actuated pressure intensifier having a tappet, and defining a pressure intensification passage connecting with the nozzle supply passage;

a second electrically actuated valve comprising a spill valve movable between a first spill valve position and a second spill valve position, wherein at the first spill valve position a fluid is displaced from the pump group to a low pressure space and at the second spill valve position the fluid is displaced from the pump group to the pressure intensification passage; and a one-way valve configured to block fuel flow from the nozzle group to the pump group, the one-way valve being positioned fluidly between the nozzle supply passage and the pump group and movable via a fluid pressure in the nozzle supply passage to a first one-way valve position at which the one-way valve fluidly blocks the pump group from the nozzle group, the one-way valve further being movable via a fluid pressure in the pressure intensification passage to a second one-way valve position at which the one-way valve does not block the pump group from the nozzle group.

17. The fuel injector of claim 16 further comprising a second one-way valve configured to block fuel flow from the nozzle group to the high pressure fuel inlet.

18. The fuel injector of claim 17 wherein the pump group includes a pump chamber and a bi-directional passage fluidly connecting the pump chamber with the low pressure fuel inlet, and wherein the first electrically actuated valve connects the control passage with the bi-directional passage when the first electrically actuated valve is at its second position.

* * * * *